US009359999B2

(12) United States Patent
Ohligschlaeger et al.

(10) Patent No.: US 9,359,999 B2
(45) Date of Patent: Jun. 7, 2016

(54) PRESSURE-REGULATING RECIPROCATING-PISTON PUMP HAVING A MAGNET DRIVE

(71) Applicant: Thomas Magnete GmbH, Herdorf (DE)

(72) Inventors: Olaf Ohligschlaeger, Gruenebach (DE); Axel Mueller, Siegen (DE); Thomas Rolland, Gebhardshain (DE); Stefan Quast, Wingendorf (DE); Rene Schulz, Burbach (DE)

(73) Assignee: Thomas Magnete GmbH, Herdorf (DE)

( * ) Notice: Subject to any disclaimer, the term of this patent is extended or adjusted under 35 U.S.C. 154(b) by 22 days.

(21) Appl. No.: 13/973,094

(22) Filed: Aug. 22, 2013

(65) Prior Publication Data

US 2013/0343921 A1 Dec. 26, 2013

Related U.S. Application Data

(63) Continuation of application No. PCT/EP2012/000837, filed on Feb. 27, 2012.

(30) Foreign Application Priority Data

Feb. 25, 2011 (DE) ..... 10 2011 012 322

(51) Int. Cl.
*F04B 17/04* (2006.01)
*F04B 17/03* (2006.01)
(Continued)

(52) U.S. Cl.
CPC ..... *F04B 17/03* (2013.01); *F04B 17/042* (2013.01); *F04B 51/00* (2013.01); *F04B 53/12* (2013.01)

(58) Field of Classification Search
CPC .... F04B 17/044; F04B 17/046; F04B 35/045; F04B 53/10; H02K 33/10
USPC ..... 417/417; 310/23, 30, 34; 267/177; 137/513.5
See application file for complete search history.

(56) References Cited

U.S. PATENT DOCUMENTS 2,669,186 A * 2/1954 Parker ..... 417/259
4,201,522 A * 5/1980 Toyota et al. ..... 417/311
(Continued)

FOREIGN PATENT DOCUMENTS

DE 1653519 A1 * 9/1971
DE 4035835 A1 5/1992
(Continued)

OTHER PUBLICATIONS

International Search Report dated May 14, 2012 for International Application No. PCT/EP2012/000837. 3 Pages.
(Continued)

*Primary Examiner* — Devon Kramer
*Assistant Examiner* — Nathan Zollinger
(74) *Attorney, Agent, or Firm* — Eschweiler & Associates, LLC

(57) ABSTRACT

The invention relates to a reciprocating piston pump having a magnet drive and a first displacement chamber and a second displacement chamber, which are separated from each other by a piston, wherein both displacement chambers are connected to each other by a fluid-conducting channel. An overflow valve is arranged in the channel and allows a preferred flow from the first displacement chamber to the second displacement chamber, wherein an additional return valve is arranged either in a transition region between an inlet and the first displacement chamber or in a transition region between the second displacement chamber and an outlet, an armature of the magnet drive being firmly connected to the piston.

21 Claims, 3 Drawing Sheets

(51) Int. Cl.
*F04B 51/00* (2006.01)
*F04B 53/12* (2006.01)

(56) References Cited

U.S. PATENT DOCUMENTS

| | | | | |
|---|---|---|---|---|
| 4,306,843 | A * | 12/1981 | Arai | 417/417 |
| 4,743,179 | A | 5/1988 | Waas et al. | |
| 5,694,808 | A | 12/1997 | Weis | |
| 6,554,588 | B1 * | 4/2003 | DiBenedetto | 417/417 |

FOREIGN PATENT DOCUMENTS

| | | | |
|---|---|---|---|
| DE | 4328621 | A1 | 3/1995 |
| DE | 29821022 | U1 | 7/1999 |
| DE | 10227659 | A1 | 1/2004 |
| DE | 102006019584 | A1 | 11/2007 |
| DE | 102008013441 | A1 | 9/2009 |
| DE | 102008055611 | A1 | 5/2010 |
| EP | 1764504 | A1 | 3/2007 |
| EP | 2093422 | A1 | 8/2009 |
| WO | 9002066 | A1 | 3/1990 |
| WO | 9512761 | A1 | 5/1995 |
| WO | 2007124873 | A1 | 11/2007 |

OTHER PUBLICATIONS

International Preliminary Report on Patentability dated Sep. 6, 2013 for International Application No. PCT/EP2012/000837. 11 Pages.

* cited by examiner

PRESSURE-REGULATING RECIPROCATING-PISTON PUMP HAVING A MAGNET DRIVE

REFERENCE TO RELATED APPLICATIONS

This application is a continuation of International application number PCT/EP2012/000837 filed on Feb. 27, 2012, which claims priority to German application number 10 2011 012 322.9 filed on Feb. 25, 2011.

FIELD

The invention relates to a reciprocating-piston pump which is driven by magnets, and to a method for producing and for operating a reciprocating-piston pump.

BACKGROUND

Reciprocating-piston pumps which are driven by a magnet are known, for example, from documents DE 43 28 621 C2, DE 102 27 659 B4, DE 10 2006 019 584 B4 or DE 10 2008 010 073 B4. Said pumps are used as a rule as metering or delivery pumps and serve to deliver a proportional conveying flow depending on the frequency of the electric actuation.

Furthermore, units which are called a metering pump or linearly driven pumps are known, for example, from property rights DE 40 35 835 A1, DE 10 2008 013 441 B4 or DE 298 21 022 U1.

DE 35 04 789 A1 describes a reciprocating-piston pump having an electromagnetic drive, in which an armature with a piston, which is connected thereto and configured as a piston rod, is moved away from an outlet on account of the excitation of a coil. The pump also includes a restoring spring which is supported against the armature and a spring abutment being stressed during the movement away from the outlet. When the coil is de-energized, the restoring spring moves the actuator which is formed from the armature and piston rod against an outlet stop which forms an adjustable end stop for the actuator within the housing of the pump. The pump has a suction-side first displacement space which is called a suction space and a second displacement space which is called an armature space, which displacement spaces are connected to one another by a fluid-conducting channel and a nonreturn valve provided therein and radial holes in such a way that a preferred flow from the first to the second displacement space is made possible. Here, a further nonreturn valve is arranged in a transition region between an inlet and the first displacement space. Here, the restoring spring has a prestress which is sufficient to displace the actuator against the outlet upon de-energization and to eject the entire volume of the second displacement space. In addition, the active force of the restoring spring is further reinforced by virtue of the fact that the inlet-side end face of the piston which faces the first displacement space is loaded with fluid there and is therefore pressed in the direction of the outlet. Although the prestress of the restoring spring can also be increased by way of the setting of the position of the outlet stop, its force is already far higher than a counterforce which results from the setpoint value of the pressure and cross section of the outlet face, with the result that no adaptation to the setpoint value of the pressure in the outlet is possible in this way.

SUMMARY

In one embodiment a pump is provided that generates, not a predefined delivery flow, but rather a predefined pressure at the pump outlet and adapts the delivery flow automatically depending on the requirement of the connected consumer. Since the inlet pressure is known and is approximately constant, the generation of a predefined pressure difference between the outlet and inlet is also expedient.

Automatically pressure-regulating pumps are known as rotationally operating pumps from the specialist field of oil hydraulics, to be precise either as valve-controlled variable displacement pumps, for example "Bosch Rexroth A10VOxDR/5", or as variable displacement pumps, the effective displacement volumes of which are modified directly by the pressure to be regulated, for example "Bosch Rexroth PV7-2X/ . . . ". The rotary pumps are widespread, but considerably too large and too expensive for the application here.

Pressure regulation is also achieved by the combination of a known metering pump with a pressure limiting valve which is connected to the line between the pump and the consumer, but this leads to a higher structural outlay, the risk of oscillations and possibly a considerable temperature influence on the pressure regulation.

In one embodiment a reciprocating-piston pump is disclosed having a magnetic drive and a method for producing and operating it, which achieve favorable and reliable automatic pressure regulation with a low structural outlay.

According to one embodiment, a reciprocating-piston pump which is driven by a magnet and has the indicated means is designed in such a way that it delivers only the fluid flow which is necessary to maintain the required pressure. To this end, the generated pressure counteracts the movement of the delivery piston and, if the limit value which is predetermined by the force balance at the piston is exceeded, brings the movement of the piston to a standstill. As a result, the piston covers only a part stroke; and the magnitude of the part stroke is dependent directly on the pressure which is built up and indirectly on the fluid requirement of the consumer.

In order to utilize the equilibrium of the forces at the piston to regulate the pressure, it is not appropriate, however, to utilize the force of the magnet during the delivery phase, because the magnetic force is subject to great fluctuations as a result of the supply voltage and the coil temperature. Instead, the force of the restoring spring is utilized for delivery and for force calibration. The piston stroke after the magnet is switched on is used merely to pump fluid from the first displacement space into the second displacement space and to stress the restoring spring. The force of the restoring spring is not influenced by the stated disturbance variables of supply voltage and temperature, but rather is dependent substantially on the spring prestress of the restoring spring and the piston stroke. The influence of the stroke can be kept small by the selection of a low spring stiffness, and the pressure to be regulated by the pump can be set by the modification of the spring prestress.

If the prestress of the restoring spring can be adjusted only with unacceptable outlay or with risks for the function, it may be suitable to allow a further spring to act on the piston, the prestress of which further spring can be set considerably more easily. It is immaterial here whether the further spring, the so-called correction spring, acts in the same direction on the piston as the restoring spring, or counteracts the restoring spring, as long as only the effects of both springs are dependent on the stroke of the piston and, in the case of opposed action, the force of the restoring spring is greater than the force of the correction spring.

The restoring spring or the spring group which comprises the restoring spring and the correction spring produce, as a result of their spring stiffness, a small influence of the stroke on the pressure at the outlet, which influence can be measured, however, and can possibly be utilized. Here, above all, the partial stroke at the end of the delivery phase has an effect on the pressure over averaged time.

The described pressure regulation can be realized by way of different known designs of reciprocating-piston pumps, as long as only the delivery of the fluid takes place in the restoring phase of the work cycle, that is to say when the magnet is switched off. The reciprocating-piston pump will as a rule comprise two valves; these can be an inlet valve and an overflow valve between the displacement spaces, or an overflow valve and an outlet valve.

In a first embodiment, the reciprocating-piston pump comprises an inlet valve and an overflow valve, and the piston is mounted in the cone in a sliding and dynamically sealing manner. Since the restoring spring is supported in the cone, it is advantageous here not to set the prestress of the restoring spring, but rather to set the prestress of an additional correction spring by means of a displaceable bush. The bush is to be secured after the displacement; this can be achieved by a sufficient interference fit or by welding, soldering, adhesive bonding or calking.

In a second embodiment, the reciprocating-piston pump comprises an overflow valve and an outlet valve, and the piston is mounted in the yoke in a sliding and sealing manner. Since the cone does not comprise a sliding bearing for the piston in this case, it is possible here without risk to set the prestress of the restoring spring by means of a displaceable spring bearing. In this case, the stop bush within the spring bearing which represents the inlet-side stop for the piston has to be set subsequently to its correct size, without displacing the spring bearing further. Both the spring bearing and the stop bush have to be secured after the setting operation, in order that they are not displaced further during operation of the pump. A sufficient interference fit, welding, soldering, adhesive bonding or calking can serve to this end.

In one embodiment the spring bearing seals the pump to the outside and a completely impermeable seal toward the cone is therefore required; the methods of welding, soldering and adhesive bonding can be used for this purpose, or an elastomer seal can be inserted.

For both embodiments, the setting of the restoring spring can also be realized by virtue of the fact that the restoring spring is mounted on one side or both sides on adjusting shims which are selected as required and then inserted after a suitable test operation of the pump or a subassembly. However, this solution is considered to be less advantageous because the described test operation cannot be combined with the final test of the pump after its production.

It is also conceivable to set the bush in order to set the spring prestress of the correction spring or the spring bearing not by displacement, but rather to provide the components and the components which enclose them with threads and to perform the setting by way of rotation of the bush or the spring bearing. In this case, the securing of the position will be performed in a known manner by locking with a further component which is provided with a thread or by adhesive bonding. These procedures are also considered to be less advantageous, since they are associated with higher costs and because the seal of a spring bearing which is screwed in is firstly necessary and secondly complicated.

In some fields of application of the pump, it is required that, after the pump is switched off, the fluid flows back slowly into the storage reservoir which is connected to the inlet side. To this end, a deliberate leak is then provided in the two valves, which leak is so great that a sufficient outflow takes place after the pump is switched off, but is only so small that the delivery function is not impaired during normal operation. The sealing gap of the dynamic seal between the piston and the piston bearing is also designed for the same leak.

In other fields of application, it is required that, after the pump is switched off, a defined residual pressure is maintained, but is not exceeded as a result of temperature-induced expansion of the fluid. To this end, the piston of the pump is provided with an outlet-side sealing stop ring, the active sealing face of which in interaction with the force of the restoring spring results in the required residual pressure.

In many applications, an outlet pressure of the pump which is as uniform as possible is required, which outlet pressure is additionally not to be exceeded or is to be exceeded only slightly if the fluid freezes after the pump is switched off. To this end, a compensation volume which is variable under pressure is separated from the second displacement space, which compensation volume is integrated into the pump housing in one advantageous embodiment and therefore requires only a small amount of additional installation space. The variable compensation volume is delimited by a tubular elastic diaphragm; a closed gas volume is situated on that side of the diaphragm which faces away from the working fluid. Fluid dampers are known per se, but not in interaction with pressure-regulating reciprocating-piston pumps as described here.

The reciprocating-piston pump according to this invention is distinguished by a very small overall size and low production costs in comparison with known pumps with a similar function. On account of its robustness, it can also be used under adverse environmental conditions in a large temperature range. It is suitable, in particular, for large-scale applications in automotive engineering, for example for the supply of systems for injecting additive or fuel into the exhaust gas section of internal combustion engines. Liquids which freeze in the range of the environmental conditions which are specified for the application can also be conveyed by way of the pump when they have thawed again.

Further advantages, developments, properties, features and functions of the invention result from the following description of example embodiments and the claims.

BRIEF DESCRIPTION OF THE DRAWINGS

In the following text, the invention will be explained in greater detail using example embodiments with reference to the appended drawings.

DETAILED DESCRIPTION

Figure 1:
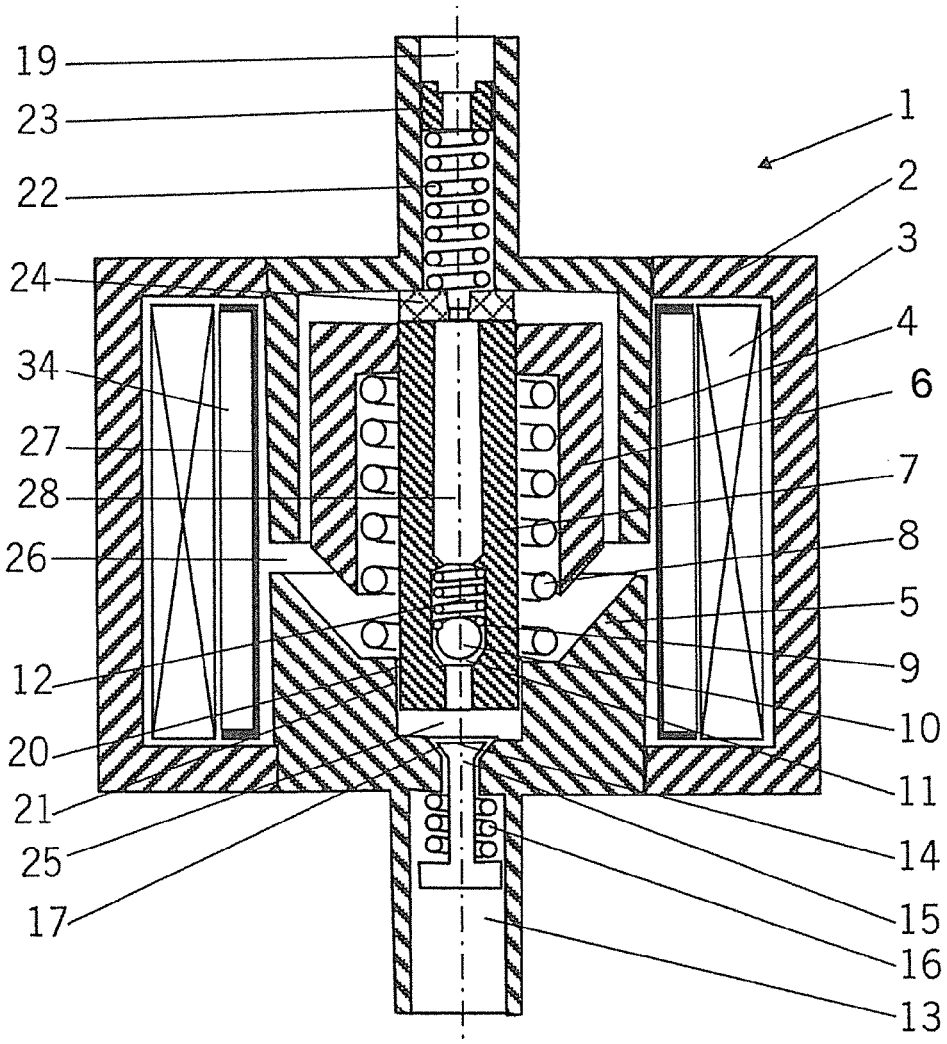
FIG. 1 shows a first example embodiment of a reciprocating-piston pump according to the invention in a non-energized state with an inlet valve, without an outlet valve and with a correction spring.

FIG. 1 shows a first example of a reciprocating-piston pump 1 which is driven by a magnet which comprises a magnet housing 2, a coil 3, a yoke 4, a cone 5 and an armature 6. The primary air gap, at which the axial magnetic force is built up, is situated between the armature 6 and the cone 5. The secondary air gap between the yoke 4 and the armature 6 builds up only a negligibly small axial magnetic force; the secondary air gap serves only to guide the magnetic flux.

The armature 6 is connected to the piston 7 of the pump 1, and both are pressed into a starting position by a restoring spring 8. The piston 7 and the armature 6 are additionally loaded with a stroke-dependent force by a correction means which is configured as a correction spring 22.

The magnet is supplied cyclically with the working voltage by an electric actuation means (not shown); the working cycle of the pump 1 is produced by the switching on and off of the working voltage.

The piston 7 is mounted in a bore of the cone 5; the piston 7 and the cone 5 form a sliding bearing 20 with the cylindrical faces which slide in one another, which sliding bearing 20 is of such tight design that it at the same time also fulfils the function of a dynamic seal with a sealing gap 21.

The interior of the pump 1 is divided into two displacement spaces by the dynamic seal 20: the first displacement space 25 is connected via an inlet valve 14 to an inlet 13 of the pump 1; when the piston 7 is situated in the rest position without magnetic force and pressure, the second displacement space 26 is connected to an outlet 19 of the pump 1.

The two displacement spaces 25, 26 are connected to one another by the channel 28 which can run, for example, in the interior of the piston 7 and which comprises an overflow valve 9 which, in one embodiment, permits only a fluid flow from the first displacement space 25 to the second displacement space 26.

In one embodiment the overflow valve 9 is advantageously configured as a ball check valve, comprising a ball 10, a valve spring 12 and a sealing seat 11 which is part of the piston 7. Here, the sealing seat 11 is provided with a groove or an elevation which is dimensioned in such a way that a defined leakage flow can flow.

The inlet valve 14 is configured as a conical nonreturn valve; it comprises a valve cone 15, a valve spring 16 and a sealing seat 17 which is part of the cone 5.

In the rest position without magnetic force and pressure, the piston 7 bears via the stop ring 24 against the rear wall of the yoke 4. In this embodiment, the stop ring is perforated, in order that the channel 28 is always connected to the outlet 19.

The outlet 19 is formed integrally on the yoke 4 and comprises the correction spring 22 which is clamped between a setting bush 23 and the stop ring 24.

Figure 3:
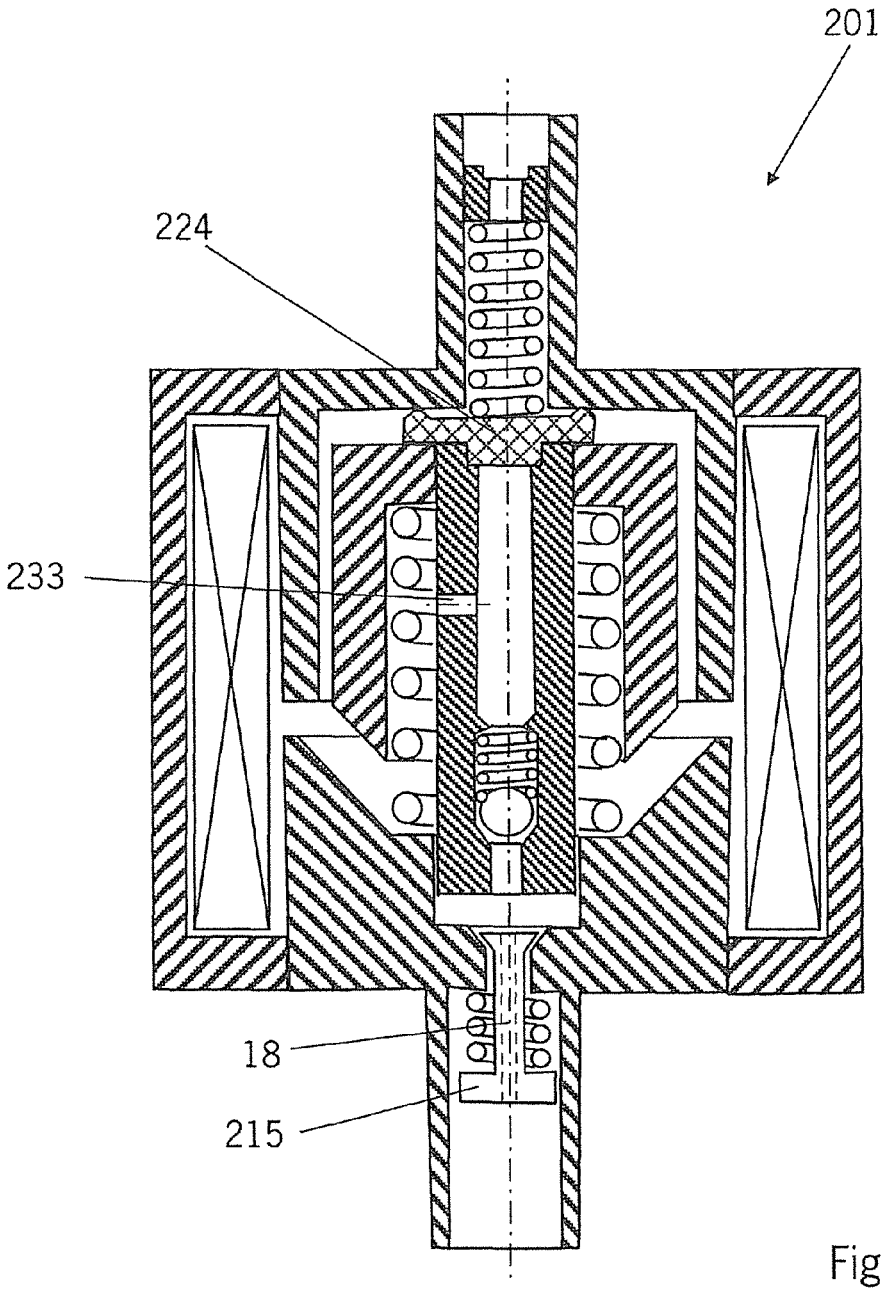
FIG. 3 shows a third example embodiment of a reciprocating-piston pump according to the invention with a protective means against backflow.

The valve cone 15 of the inlet valve comprises a hole (not shown in detail in FIG. 1) which penetrates the valve cone 15 and has a small diameter, as is shown in FIG. 3 as hole 18, with the result that a defined leakage which causes a restricted outflow of the fluid toward the inlet 13 is achieved.

Finally, the dynamic seal 20 between the piston 7 and the mounting in the cone 5 also has a leak which is dependent on the gap height in the bearing. The gap height is adapted to the leakage requirement in the application.

FIG. 1 also describes the integration of a fluid damper into the reciprocating-piston pump 1. To this end, a diaphragm 27 divides the second displacement space 26; that side of the diaphragm 27 which faces away from the fluid is loaded by a gas which is situated in a shut-off space.

The function of the pump 1 according to FIG. 1 can be described best using the temporal sequence: in the rest state which is characterized by a very low pressure at the outlet 19 of the pump 1 and by a de-energized state of the magnet coil 3, the restoring spring 8 presses the piston 7 onto the outlet-side stop in the yoke 4. If the magnet coil 3 is then energized, a magnetic force is built up at the primary air gap between the armature 6 and the cone 5, which magnetic force is greater than the sum of the spring forces of the restoring spring 8 and the correction spring 22. As a result, the armature 6 and the piston 7 which is connected to it move to the suction side of the pump. The first displacement space 25 is reduced in size, and the pressure therein rises above the pressure of the inlet 13. As a consequence, the inlet valve 14 closes and the overflow valve 9 opens. Fluid from the first displacement space 25 flows over into the second displacement space 26. No delivery into the outlet 19 has yet taken place during this stroke. The restoring spring 8 is stressed, and the correction spring 22 is relieved.

When the piston 7 reaches the inlet-side stop in the cone 5, or when the coil current is switched off beforehand, the forward movement of the armature 6 comes to a standstill. As soon as the magnetic force is lower than the sum of the forces of the restoring spring 8 and the correction spring 22, the movement direction of the armature 6 and of the piston 7 which is configured as a piston rod reverses. The volume of the second displacement space 26 is reduced and the volume of the first displacement space 25 is increased. The pressure in the first displacement space 25 drops and, as a result, the inlet valve 14 opens and fluid flows from the inlet 13 into the first displacement space 25.

The pressure in the second displacement space 26 rises slightly and, as a result, the overflow valve 9 closes. From this instant, fluid is pushed out of the second displacement space 26 into the outlet 19.

Since only a comparatively small fluid quantity is tapped off by the consumer on the outlet side, the pressure in the outlet 19 rises until the pressure limit value which is predefined by the forces of the springs 8 and 22 and the active area of the piston 7 is reached. When the pressure limit value is reached, the movement of the piston 7 comes to a standstill since there is no longer an excess of force in the movement direction. If further fluid is tapped off in this situation by the consumer, the springs 8 and 22 correspondingly continue to press the piston 7 and the pressure changes only slightly in the process. The pump 1 remains in this situation until a new electric actuating signal is issued to the magnet.

A new pump cycle begins with the new actuating signal, as described above, but from the position of the piston which was reached last. When the magnet is switched on, the armature 6 and piston 7 move as far as the inlet-side stop and, when the magnet is switched off, they move during operation as intended only as far as the position, in which the spring forces and the pressure force are in equilibrium. This results in a part stroke operation, in which the stroke and therefore the delivery output of the pump are dependent on the requirement of the consumer which is connected downstream and the pressure at the outlet changes only to a small extent which can, however, be influenced by the frequency of the actuating pulses.

Figure 2:
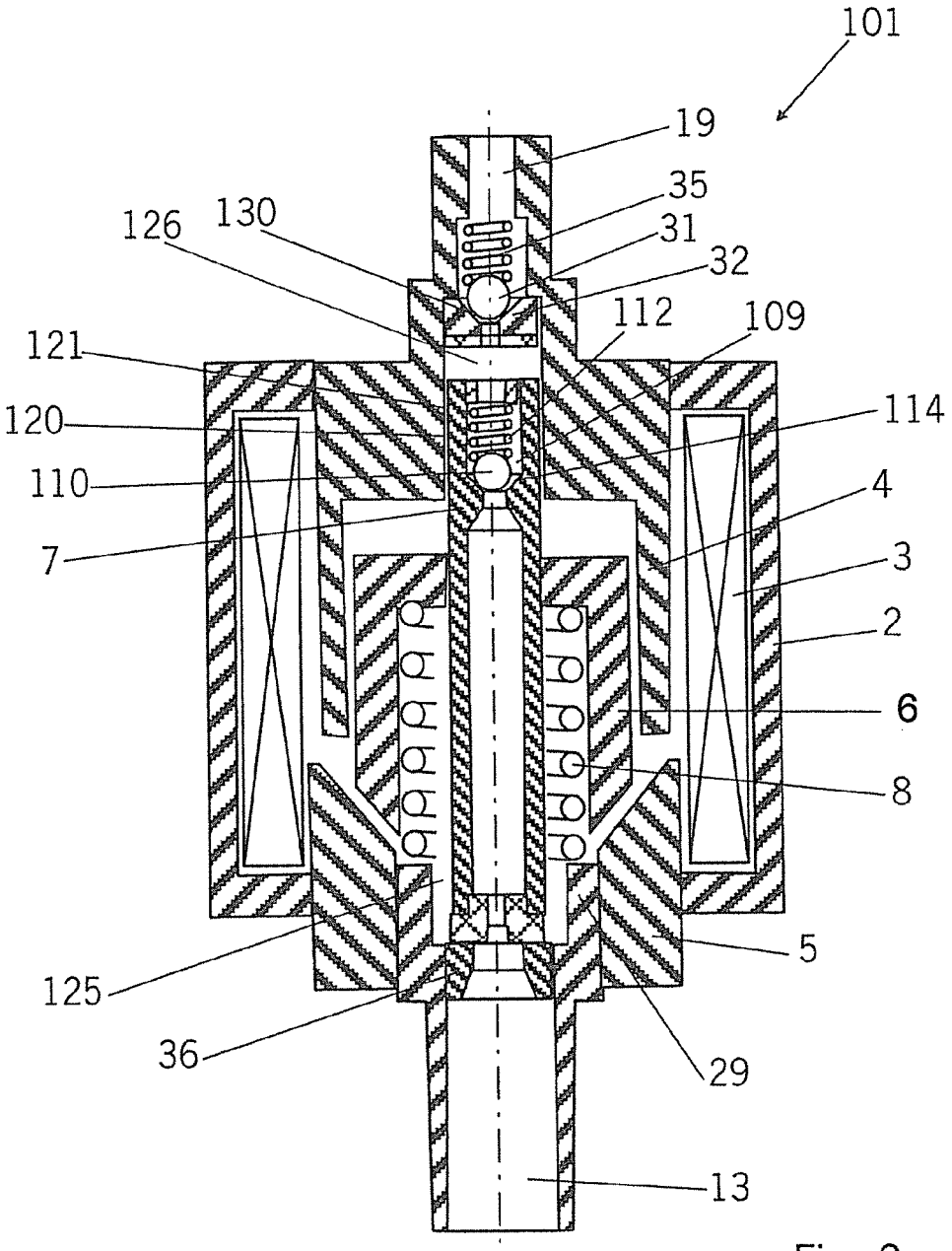
FIG. 2 shows a second example embodiment of a reciprocating-piston pump according to the invention without an inlet valve, with an outlet valve, without a correction spring with an adjustable spring bearing for a restoring spring.

An alternative example embodiment of a reciprocating-piston pump 101 is shown in FIG. 2. The same designations as in FIG. 1 or the designations incremented by 100 denote the same or structurally comparable parts here which will no longer be introduced separately.

In the embodiment according to FIG. 2, no inlet valve is arranged in the inlet 13 and, in contrast, an outlet valve 130 is provided in the outlet 19, which outlet valve 130 ensures the pump function in interaction with the piston 7 and an overflow valve 109. The outlet valve 130 comprises a ball 31, a sealing seat 32 and a spring 35. The outlet valve 130 according to FIG. 2 has a sealing seat 32 which is provided with a suitable groove or a suitable elevation, in order to make a leakage flow possible.

A correction spring 22 is not provided in the embodiment according to FIG. 2; an adjustable spring bearing 29 is provided instead which makes an adjustment of the prestressing force of the restoring spring 8 possible. The adjustable spring bearing 29 and the inlet 13 are configured as one component which can be fixed in the cone 5. A stop bush 36 which limits the stroke of the armature 6 is situated within the inlet 13.

In contrast to FIG. 1, the piston 7 in the embodiment according to FIG. 2 is mounted in a corresponding bore in the yoke 4, with the result that the outer circumference of the piston 7 and the bore in the yoke 4 together form a sliding bearing 120 with a sliding seal 121.

Finally, the dynamic seal 120 between the piston 7 and the mounting in the yoke 4 also has a leak which is dependent on the gap height in the bearing 120. The gap height is adapted to the leakage requirement in the application.

A slightly modified function results for the refinement of the pump 101 with an outlet valve 130 and without a correction spring 22 according to FIG. 2: in the rest state which is characterized by a very low pressure at the outlet 19 of the pump 101 and by a de-energized state of the magnet coil 3, the restoring spring 8 presses the piston 7 onto the outlet-side stop in the yoke 4. If the magnet coil 3 is then energized, a magnetic force is built up at the primary air gap between the armature 6 and the cone 5, which magnetic force is greater than the force of the restoring spring 8. As a result, the armature 6 and the piston 7 which is connected to it move to the suction side of the pump 101. The second displacement space 126 is increased in size, and the pressure therein falls below the pressure of the outlet 19. As a consequence, the outlet valve 130 closes and the overflow valve 109 opens. Fluid from the first displacement space 125 flows over into the second displacement space 126. No delivery into the outlet 19 has yet taken place during this stroke. The restoring spring 8 is stressed.

When the piston 7 reaches the inlet-side stop on the stop bush 36, or when the coil current is switched off beforehand, the forward movement of the armature 6 comes to a standstill. As soon as the magnetic force is lower than the force of the restoring spring 8, the movement direction of the armature 6 reverses. The volume of the second displacement space 126 is reduced and the volume of the first displacement space 125 is increased. The pressure in the first displacement space 125 drops and, as a result, fluid flows from the inlet 13 into the first displacement space 125. The pressure in the second displacement space 126 rises slightly and, as a result, the overflow valve 109 closes and the outlet valve 130 opens. From this instant, fluid is pushed out of the second displacement space 126 into the outlet 19. Since only a comparatively small fluid quantity is tapped off by the consumer on the outlet side, the pressure in the outlet 19 rises until the pressure limit value which is predefined by the force of the restoring spring 8 and the active area of the piston 7 is reached. When the pressure limit value is reached, the movement of the piston 7 comes to a standstill because there is no longer an excess of force in the movement direction. If further fluid is tapped off by the consumer in this situation, the spring 8 continues to press the piston 7 correspondingly, and the pressure changes only slightly in the process. The pump remains in this situation until a new electric actuating signal is issued to the magnet.

A new pump cycle begins with the new actuating signal, as described above, but from the position of the piston which was reached last. When the magnet is switched on, the armature 6 and piston 7 move as far as the inlet-side stop and, when the magnet is switched off, they move during operation as intended only as far as the position, in which the spring forces and the pressure force are in equilibrium. This results in a part stroke operation, in which the stroke and therefore the delivery output of the pump are dependent on the requirement of the consumer which is connected downstream and the pressure at the outlet changes only to a small extent which can, however, be influenced by the frequency of the actuating pulses.

FIG. 3 describes an embodiment of a reciprocating-piston pump 201 which is modified only slightly in comparison with the reciprocating-piston pump 1 from FIG. 1, with the result that the same designations as in FIG. 1 or the designations incremented by 200 denote the same or structurally comparable parts here which will no longer be introduced separately.

The reciprocating-piston pump 201 has a stop ring 224 which prevents a further flow of fluid to the outlet 19, as a result of the sealing of the displacement space 26 with respect to the outlet 19 after the pump 201 is switched off, and maintains a low minimum pressure in the line which is connected at the outlet 19, which minimum pressure results from the force of the restoring spring 8 and the active sealing area of the stop ring 224. In this embodiment, the channel 28 is connected to the second displacement space 26 by a hole 233.

A leakage hole 18 which penetrates the valve member 215 axially is shown by dashed lines in the valve member 215 which has the valve cone 15.

A method for pressure setting then takes place as follows: each of the above-described pumps 1, 101, 201 is assembled in a known way and inserted into a function test bench. The inlet 13 is connected to a supply tank and the outlet 19 is connected to a pressure reservoir.

The pump 101 is then energized cyclically and a pressure builds up in the pressure reservoir. The pressure is compared with a setpoint value, and a correction value for setting the spring prestress of the restoring spring 8 is calculated from the deviation of the pressure from the setpoint value. In accordance with the correction value, the spring bearing 29 of the restoring spring 8 is displaced. The spring bearing 29 is gripped with an interference fit in the cone 5 of the magnet, that is to say can be displaced with high force, but then remains in its position during operation of the pump 101. If the design of the interference fit makes it necessary, the spring bearing 29 is secured after the setting operation. After the setting and securing of the spring bearing 29, the stop bush 36 is set to its correct size, without displacing the spring bearing 29 further in the process. The bush 36 is also secured if this is required.

As an alternative, the pump 1, 201 has an additional correction spring 22, with the result that the spring prestress of the restoring spring 8 does not need to be adjusted. In this case, instead of a spring bearing of the restoring spring 8, the setting bush 23 is displaced which forms the spring bearing of the correction spring 22. The setting bush 23 is also gripped in an interference fit, in the component outlet 19 in this case. If it is necessary according to the design, the setting bush 23 is secured after the setting operation.

Whereas the above-described setting of the pressure takes place immediately after production, a small change in the pressure can still be achieved during operation, by the frequency of the actuation and therefore the part stroke which is present over the averaged time being changed, because the spring stiffness of the restoring spring and possibly of the correction spring brings about a slightly stroke-dependent force.

The invention claimed is:

1. A reciprocating-piston pump, comprising:

a magnetic drive;

a first displacement space; and second displacement space, wherein the first displacement space and the second displacement space are separated from one another by a piston, wherein the first displacement space and the second displacement space are connected to one another by a fluid-conducting channel, wherein an overflow valve allowing a flow from the first displacement space to the second displacement space is arranged in the fluid-conducting channel, wherein a further nonreturn valve is arranged in a transition region, wherein the transition region is positioned at one of a region between an inlet and the first displacement space and a region between the second displacement space and an outlet, wherein an armature of the magnetic drive is fixedly connected to the piston, wherein the piston is mounted in an axially displaceable manner in a sliding bearing, wherein the sliding bearing is dimensioned such that the sliding bearing acts as a dynamic seal which separates the first displacement space and the second displacement space from one another, wherein a restoring arrangement is arranged and dimensioned such that the restoring arrangement restores the armature in the direction of its starting position after the magnetic drive is switched off, wherein a prestress of the restoring arrangement is adapted to a selected setpoint value of the pressure in the outlet, wherein the prestress of the restoring arrangement is configured to be externally set by displacement of a static spring mounting, wherein the restoring arrangement comprises a group of springs, the group of springs comprising a spring and a correction spring, wherein the correction spring prestresses the armature into its starting position, and wherein the spring force of the correction spring is set by the displacement of a setting bush which serves as spring bearing and is arranged displaceably in the outlet.

2. The reciprocating-piston pump as claimed in claim 1, wherein the setting bush is gripped in the outlet in an interference fit which permits a displacement with high force, and is dimensioned or is assisted by a securing unit in such a way that the position is maintained during operation of the pump.

3. The reciprocating-piston pump as claimed in claim 1, wherein the nonreturn valve is an inlet valve provided with a slight defined leakiness, by a valve cone of the inlet valve comprising a leakage hole.

4. The reciprocating-piston pump as claimed in claim 1, wherein the sliding bearing and the overflow valve are connected in parallel to one another.

5. The reciprocating-piston pump as claimed in claim 1, wherein a working fluid is associated with the second displacement space, wherein a part of the second displacement space is separated by an elastic diaphragm, and wherein the separated space on a side of the diaphragm which faces away from the working fluid is filled with gas and forms a damper together with the diaphragm.

6. A reciprocating-piston pump, comprising:

a magnetic drive;

a first displacement space; and a second displacement space, wherein the first displacement space and the second displacement space are separated from one another by a piston, wherein the first displacement space and the second displacement space are connected to one another by a fluid-conducting channel, wherein an overflow valve allowing a flow from the first displacement space to the second displacement space is arranged in the fluid-conducting channel, wherein a further nonreturn valve is arranged in a transition region, wherein the transition region is positioned at one of a region between an inlet and the first displacement space and a region between the second displacement space and an outlet, wherein an armature of the magnetic drive is fixedly connected to the piston, wherein the piston is mounted in an axially displaceable manner in a sliding bearing, wherein the sliding bearing is dimensioned such that the sliding bearing acts as a dynamic seal which separates the first displacement space and the second displacement space from one another, wherein a restoring arrangement is arranged and dimensioned such that the restoring arrangement restores the armature in the direction of its starting position after the magnetic drive is switched off, wherein a prestress of the restoring arrangement is adapted to a selected setpoint value of the pressure in the outlet, wherein the prestress of the restoring arrangement is configured to be externally set by displacement of a static spring mounting, wherein the nonreturn valve is an inlet valve provided with a slight defined leakiness, by a valve cone of the inlet valve comprising a leakage hole; and wherein a sealing gap of the sliding bearing between the piston and the sliding bearing has a size adapted to the size of the leakage hole.

7. The reciprocating-piston pump as claimed in claim 6, wherein the static spring mounting is arranged so as to lie opposite the armature, and wherein the restoring arrangement which is to be set is arranged between the spring mounting and the armature.

8. A reciprocating-piston pump, comprising:

a magnetic drive;

a first displacement space; and a second displacement space, wherein the first displacement space and the second displacement space are separated from one another by a piston, wherein the first displacement space and the second displacement space are connected to one another by a fluid-conducting channel, wherein an overflow valve allowing a flow from the first displacement space to the second displacement space is arranged in the fluid-conducting channel, wherein a further nonreturn valve is arranged in a transition region, wherein the transition region is positioned at one of a region between an inlet and the first displacement space and a region between the second displacement space and an outlet, wherein an armature of the magnetic drive is fixedly connected to the piston, wherein the piston is mounted in an axially displaceable manner in a sliding bearing, wherein the sliding bearing is dimensioned such that the sliding bearing acts as a dynamic seal which separates the first displacement space and the second displacement space from one another, wherein a restoring arrangement is arranged and dimensioned such that the restoring arrangement restores the armature in the direction of its starting position after the magnetic drive is switched off, wherein a prestress of the restoring arrangement is adapted to a selected setpoint value of the pressure in the outlet, wherein the prestress of the restoring arrangement is configured to be externally set by displacement of a static spring mounting, and wherein the piston is provided with a stop ring which is made from an elastic material and, in the rest position of the piston which results when the magnetic drive is switched off and there is a very low pressure in the outlet, seals the second displacement space with respect to the outlet, the stop ring being perforated, with the result that the channel remains connected to the outlet.

9. The reciprocating-piston pump as claimed in claim 8, wherein the overflow valve in the channel is provided with a slight defined leakiness by a sealing seat of the overflow valve being provided with one of a groove and an elevation.

10. A reciprocating-piston pump, comprising:

a magnetic drive;

a first displacement space; and a second displacement space, wherein the first displacement space and the second displacement space are separated from one another by a piston, wherein the first displacement space and the second displacement space are connected to one another by a fluid-conducting channel, wherein an overflow valve allowing a flow from the first displacement space to the second displacement space is arranged in the fluid-conducting channel, wherein a further nonreturn valve is arranged in a transition region, wherein the transition region is positioned at one of a region between an inlet and the first displacement space and a region between the second displacement space and an outlet, wherein an armature of the magnetic drive is fixedly connected to the piston, wherein the piston is mounted in an axially displaceable manner in a sliding bearing, wherein the sliding bearing is dimensioned such that the sliding bearing acts as a dynamic seal which separates the first displacement space and the second displacement space from one another, wherein a restoring arrangement is arranged and dimensioned such that the restoring arrangement restores the armature in the direction of its starting position after the magnetic drive is switched off, wherein a prestress of the restoring arrangement is adapted to a selected setpoint value of the pressure in the outlet, wherein the prestress of the restoring arrangement is configured to be externally set by displacement of a static spring mounting, and wherein the piston is provided with a stop ring which is made from an elastic material and, in the rest position of the piston which results when the magnetic drive is switched off and there is a very low pressure in the outlet, seals the second displacement space with respect to the outlet, the piston comprising a hole, with the result that the channel remains connected to the second displacement space.

11. The reciprocating-piston pump as claimed in claim 10, further comprising an outlet valve between the second displacement space and the outlet provided with a slight defined leakiness, by a sealing seat of the outlet valve being provided with one of a groove and an elevation.

12. A reciprocating-piston pump, comprising:

a magnetic drive;

a first displacement space; and a second displacement space, wherein the first displacement space and the second displacement space are separated from one another by a piston, wherein the first displacement space and the second displacement space are connected to one another by a fluid-conducting channel, wherein an overflow valve allowing a flow from the first displacement space to the second displacement space is arranged in the fluid-conducting channel, wherein a further nonreturn valve is arranged in a transition region, wherein the transition region is positioned at one of a region between an inlet and the first displacement space and a region between the second displacement space and an outlet, wherein an armature of the magnetic drive is fixedly connected to the piston, wherein the piston is mounted in an axially displaceable manner in a sliding bearing, wherein the sliding bearing is dimensioned such that the sliding bearing acts as a dynamic seal which separates the first displacement space and the second displacement space from one another, wherein a restoring arrangement is arranged and dimensioned such that the restoring arrangement restores the armature in the direction of its starting position after the magnetic drive is switched off, wherein a prestress of the restoring arrangement is adapted to a selected setpoint value of the pressure in the outlet, wherein the prestress of the restoring arrangement is configured to be set by displacement of a static spring mounting, and wherein in conjunction with a functional test of the pump, a pressure is measured in an outlet line which is connected to the outlet of the pump, this pressure is compared with a selected setpoint value and, in the case of a deviation, an abutment of the restoring arrangement is displaced in a correcting manner.

13. The reciprocating-piston pump as claimed in claim 12, wherein the abutment is secured in its position.

14. The reciprocating-piston pump as claimed in claim 13, wherein after the securing of the abutment a stop bush is compressed to its correct size and is secured if required.

15. The reciprocating-piston pump as claimed in claim 12, wherein the abutment is selected from the group comprising a setting bush for a correction spring of the restoring arrangement and a spring bearing for supporting the restoring spring.

16. The reciprocating-piston pump as claimed in claim 12, wherein the frequency of the electric actuation of the magnetic drive is set in accordance with a previously measured functional relationship between a mean pressure at the outlet and said frequency at a known fluid consumption such that a precision setting of the pressure to a setpoint value is achieved.

17. The reciprocating-piston pump as claimed in claim 12, wherein a fluid pressure in the outlet is set to equilibrate a restoring force of the restoring arrangement such that the armature is restored in the direction of its starting position after release of fluid from the outlet.

18. The reciprocating-piston pump as claimed in claim 12, wherein the restoring arrangement comprises a restoring spring which prestresses the armature into its starting position.

19. The reciprocating-piston pump as claimed in claim 18, wherein the spring force of the restoring spring can be set by displacement of a spring bearing which is arranged displaceably in a cone of the magnetic drive.

20. The reciprocating-piston pump as claimed in claim 19, wherein the spring bearing is gripped in the cone in an interference fit which permits a displacement with high force, and is dimensioned or is assisted by securing means such that the position is maintained during operation of the pump.

21. The reciprocating-piston pump as claimed in claim 12, wherein the restoring arrangement comprises a group of springs, the group of springs comprising a spring and a correction spring, wherein the correction spring prestresses the armature into its starting position.

* * * * *